US006247286B1

(12) United States Patent
Heyns

(10) Patent No.: US 6,247,286 B1
(45) Date of Patent: Jun. 19, 2001

(54) MODULAR STRUCTURAL ELEMENT

(76) Inventor: Nicolaas Albertus Heyns, 8 Primula Street, Heldervue, Somerset West 7130 (ZA)

( * ) Notice: Subject to any disclaimer, the term of this patent is extended or adjusted under 35 U.S.C. 154(b) by 0 days.

(21) Appl. No.: 09/364,217

(22) Filed: Jul. 29, 1999

(51) Int. Cl.[7] ..... E04B 2/08; E04B 5/04
(52) U.S. Cl. ..... 52/589.1; 52/592.2; 52/612
(58) Field of Search ..... 52/589.1, 592.2, 52/592.1, 612, 309.1, 309.13

(56) References Cited

U.S. PATENT DOCUMENTS

| | | | | |
|---|---|---|---|---|
| 2,303,745 | * | 12/1942 | Karreman | 52/592.2 X |
| 3,016,316 | * | 1/1962 | Olson | 52/592.2 X |
| 3,535,844 | * | 10/1970 | Glaros | 52/595 |
| 3,553,921 | * | 1/1971 | Breistein | 52/593 |
| 3,723,233 | | 3/1973 | Bourke . | |
| 4,550,543 | * | 11/1985 | Valenzano | 52/612 X |
| 4,640,850 | * | 2/1987 | Marocco | 52/612 X |
| 4,664,955 | | 5/1987 | Clem . | |
| 4,840,825 | | 6/1989 | Aristodimou . | |
| 4,931,331 | * | 6/1990 | Owens | 52/612 X |
| 5,899,040 | * | 5/1999 | Cerrato | 52/592.1 X |
| 6,021,615 | * | 2/2000 | Brown | 52/592.2 X |

* cited by examiner

*Primary Examiner*—Daniel P. Stodola
*Assistant Examiner*—Hugh B. Thompson
(74) *Attorney, Agent, or Firm*—Adams, Schwartz & Evans P.A.

(57) ABSTRACT

A modular structural element, including a planar surface layer of cladding material. A substrate layer is bonded to the surface layer and includes an outwardly-extending attachment flange defined by the thickness of the substrate layer and proximal to the surface layer around two adjacent side edges for receiving fastener elements through the thickness of the substrate layer and into the support member. A tongue projects outwardly from the flange remote from the surface layer. Two spaced-apart elements define a groove therebetween extending along adjacent sides of the substrate layer for receiving the tongue of a complementary adjacent structural element. The flange resides at all points intermediate the tongue and the surface layer for permitting the tongue to float within the groove of the complementary structural element for preventing damage to the surface layer resulting from relative movement between adjacent structural elements.

12 Claims, 7 Drawing Sheets

MODULAR STRUCTURAL ELEMENT

TECHNICAL FIELD AND BACKGROUND OF THE INVENTION

This invention relates to a modular structural element. The invention provides a structural element which can serve as a floor, wall or ceiling and which simultaneously provides both a covering to the floor, wall or ceiling while at the same time providing structural integrity, rigidity and support to the building. Rather than merely being supported by the structure of the building, the modular structural element adds structural integrity and rigidity to the building. The structural element may be adhered to the supporting structure, for example, floor or ceiling joists or wall studs, by nails, screws, bolts or adhesive. The particular type of fastener depends on where the structural element is used. For example, construction adhesive may be suitable for securing the structural elements to a floor, whereas nails or screws or bolts will likely be used when the structural elements are secured to wall or ceilings. The structural elements may be held down by their own weight to form a floor or part of a floor without adhering the elements to any supporting structure, i.e., a freefloating floor.

The modular structural panels can also be used to construct doors, table tops, counter tops, furniture or any other structure having the need for a cladded surface with substantial structural integrity.

The preferred embodiments of the invention disclosed in this application include modular panels which have a decorative stone surface layer which provide an expensive elegant appearance to the covered area. The modular panels make use of stone products, or stone products which would otherwise be waste products of other stone production techniques, and therefore provide economy as well as elegance.

Traditional methods of producing stone tiles start with a dimensional block of stone from a quarry. Strips of stone are cut from the length of the block with a block cutter. The strips are typically as long as the block and thick as the required tile. The depth of the cut or width of the strip is approximately the width of the required tile, for example, 12" or 16". The strips are squared and polished and then cut into tiles of a required size. The edges are then beveled and grooves cut into the bottom surface of the tiles to provide greater surface area between the bottom surface of the tile and the mounting adhesive. The tiles are then washed, dried and buffed before final inspection and packaging.

The production process has resulted in substantial waste as larger and larger blocks are demanded for larger format slabs and strips. Much beautiful material is reduced to waste or cut up into smaller or irregular formats. This substantially increases the cost of the material.

The high cost of these materials and the installation thereof has thus far prevented the stone industry from penetrating the residential market with products which are affordable enough to be sold in home improvement centers and other mass market outlets.

The construction and assembly principles also permit use of the invention with surface layers such as ceramic, glass, mirrors, wood and even textile and paper coverings.

In the commercial building industry, when wall cladding of marble, granite or other similar material is required, relatively thick slabs of the cladding material are hung from a supporting substructure by means of elaborate hanging systems. Such hanging systems are far too elaborate and costly for the residential building industry.

The conventional practice in the residential building industry is to erect a framework structure of timber or aluminum in order to secure plywood or other substrate panels to the framework structure, commonly referred to as "drywalling." The panelled areas are then sealed and customarily a secondary panel is added in order to prevent cracking of the tiles used in the cladding process. While less costly than hanging systems that are used in the commercial building industry, it requires the involvement of at least two craftsmen, namely a carpenter to erect the framework structure plywood and carry out the preparatory work, and a tiler or stone mason to apply the cladding. Installation is costly, cumbersome and results in the creation of significant amounts of dust and other construction debris which must be cleaned up and carried off.

Less conventional, but accepted, methods are to incorporate timber into a cast concrete structure or to attach timber to an existing brick structure in order to secure plywood or other panels to the timber prior to applying the cladding materials.

SUMMARY OF THE INVENTION

Therefore, it is an object of the invention to provide a modular structural element which provides an elegant, high quality surface for wall, floors and ceilings.

It is another object of the invention to provide a modular structural element which can be used directly onto a building structure such as a flooring slab, floor or ceiling joists, wall studs or board or other framework structures to provide both a finished appearance to the surface while adding significant structural integrity and rigidity.

It is another object of the invention to provide a modular structural element which provides a secure means of attachment to an underlying structure.

It is another object of the invention to provide a modular structural element which provides means of securing the interlocking of such elements into a flush array forming a floor, wall or ceiling incorporating the surface cladding material.

It is another object of the invention to eliminate costly and cumbersome installation and labor.

It is another object of the invention to provide a structural element wherein the means of adhering the modular structural elements to each other and to its supporting surface are hidden from view.

It is another object of the invention to provide a structural element which is constructed to prevent movement, cracking, warping and pulling of the cladding material.

It is another object of the invention to provide a structural element which avoids breakage during installation.

It is another object of the invention to provide modular structural elements which fit together precisely without grout lines.

It is another object of the invention to provide a modular structural element which can be removed from the supporting surface and reused in another location.

It is another object of the invention to provide a modular structural element which eliminates traditional materials and processes when installing marble, ceramic or like materials.

These and other objects of the present invention are achieved in the preferred embodiments disclosed below by providing a modular structural element comprising a surface layer of a cladding material and a substrate layer of structural material oriented in a fixed relation to an underside of the surface layer of cladding material. The substrate layer projects outwardly beyond at least one side edge of the surface layer for supporting the surface layer on a supporting structure. A tongue is carried by and projects outwardly from the at least one side of the substrate layer. A groove is formed in the substrate layer, and is positioned on the underside of the surface layer for cooperating with the outwardly projecting tongue of a complementary structural element for joining the structural element to the complementary structural element.

According to one preferred embodiment of the invention, a modular structural element is provided, comprising a surface layer of cladding material and a substrate layer of structural material oriented in a fixed relation to an underside of the surface layer of cladding material. A substrate layer of structural material is oriented in a fixed relation to an underside of the surface layer of cladding material. The substrate layer projects outwardly beyond at least one side edge of the surface layer for supporting the surface layer on a supporting structure. A groove is formed in and projects outwardly from the at least one side of the substrate layer. A tongue is formed in the substrate layer, and is positioned on the underside of the surface layer for cooperating with the outwardly projecting groove of a complementary structural element for joining the structural element to the complementary structural element.

According to another preferred embodiment of the invention, the surface layer is quadrilateral, the substrate layer extends outwardly from two adjacent sides of the surface layer, and the groove is positioned on two complementary adjacent sides of the substrate layer for receiving the tongue.

According to another preferred embodiment of the invention, the substrate layer comprises an attachment location for receiving fasteners therethrough into the supporting structure for supporting the structural element thereon, and the tongue and groove are positioned in relation the substrate layer so as to be in complementary spaced-apart relation to the supporting element when supported on the supporting structure.

According to yet another preferred embodiment of the invention, the surface layer comprises a stone material.

According to yet another preferred embodiment of the invention, the surface layer comprises glass.

According to yet another preferred embodiment of the invention, the surface layer comprises wood, ceramic, mirror, textiles, paper, plastic or a combination of these materials.

Preferably, the substrate layer comprises a first substrate layer segment carrying the tongue and a second substrate layer carrying the groove and defining therebetween a void extending the length of the building element.

According to yet another preferred embodiment of the invention, the surface layer is of an irregular shape.

According to yet another preferred embodiment of the invention, the building structure on which the building element is supported is a ceiling.

According to yet another preferred embodiment of the invention, the building structure on which the building element is supported is a wall.

According to yet another preferred embodiment of the invention, the building structure on which the building element is supported is a subfloor, a floor joist or concrete floor.

According to yet another preferred embodiment of the invention, a modular structural building element is provided, and comprises a surface layer of building material and a substrate layer of structural building material oriented in a fixed relation to an underside of the surface layer of building material. The substrate layer projects outwardly beyond at least one side edge of the surface layer for supporting the surface layer on a building structure. First interlocking members are carried by and project outwardly from the at least one side of the substrate layer. Second alternating interlocking members are positioned on the underside of the surface layer for cooperating with the outwardly projecting interlocking members of a complementary building element for joining the building element to the complementary building element.

According to one preferred embodiment of the invention, the first and second alternating interlocking members comprise dovetail members.

According to another preferred embodiment of the invention, the surface layer is rectangular.

According to yet another preferred embodiment of the invention, the surface layer is square.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
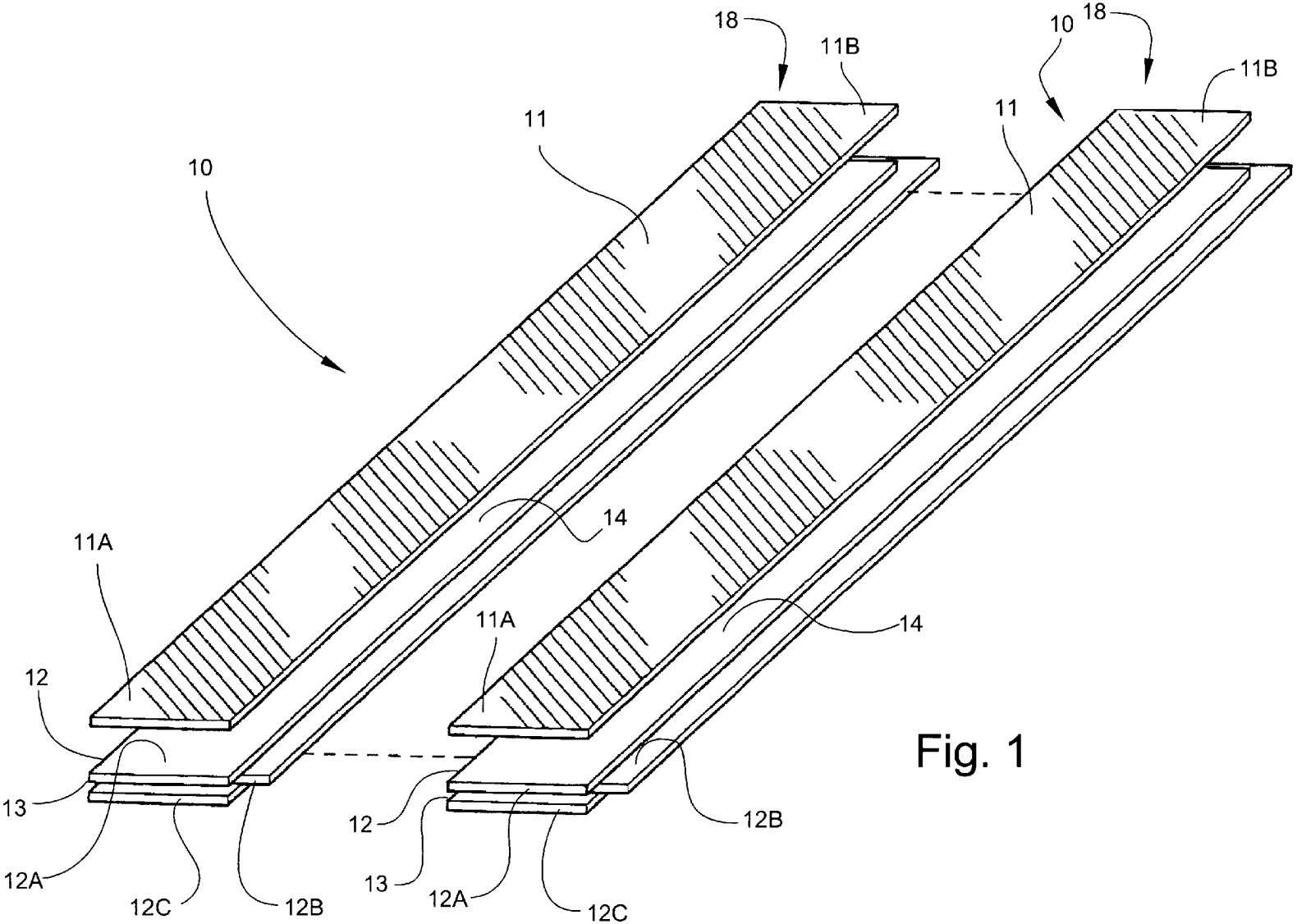
FIG. 1 is a perspective view of two modular structural elements according to one embodiment of the invention.

Referring now specifically to the drawings, a pair of modular structural elements according to the present invention is illustrated in FIG. 1 and shown generally at reference numeral 10. The modular structural elements 10 each include a surface layer 11 of a cladding material such as finished stone, glass, mirror, ceramic, wood, textiles paper or plastic, or a combination of these materials. Any cladding material which can be bonded to a substrate can be used as the cladding surface.

The modular structural elements 10 also each include a substrate layer 12 to which the surface layer 11 of cladding material is bonded by a suitable adhesive, for example, a moisture-curable construction adhesive or two-part epoxy adhesive. The substrate layer 12 may be of wood, aluminum, plastic or composite materials.

The substrate layer 12 is preferably formed of a solid construction material which defines a tongue 12B which cooperates with a groove 13 in a groove member defined between spaced-apart wooden extensions 12A and 12C. The tongue 12B and groove 13 are preferably formed by milling a single thickness of wood or using other materials such as aluminum, metal, plastic or composite materials and may be formed by the extrusion of such materials.

Figure 2:
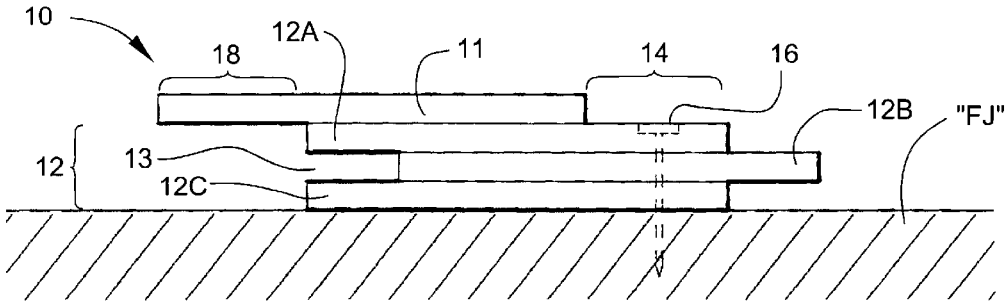
FIG. 2 is a side elevation showing attachment of the modular structural element through the substrate adjacent the tongue.

As is best shown in FIG. 2, an attaching portion 14 of the substrate layer projects outwardly beyond one side edge of the surface layer 11. This attaching portion 14 provides an exposed, solid structure through which fasteners 16 such as nails, screws or bolts can be extended into a supporting structure such as a floor joist "FJ." Note that the length of the attaching portion 14 matches the length of the overhang portion 18 of the surface layer 11 over the opposite side of the substrate layer 12. Thus, opposite longitudinally-extending side edges of the modular structural element 10 complement each other, so that a plurality of modular structural elements 10 can be placed side-by-side in a complementary, interlocking array. Fasteners 16 can be placed into the attaching portion 14 at any point and with any spacing necessary to achieve a required degree of attachment. The use of fasteners 16 with flat heads or countersinking is desirable to achieve a flat, regular surface on which the adjacent surface layer 11 will be supported. Adhesive is unnecessary. Holes for fasteners such as screws or bolts can be preformed during manufacture, including any countersinking, if required.

The modular structural elements 10 can be removed and reinstalled at another location merely by removing the fasteners 16 to release the modular structural elements 10 from the underlying support structure such as the floor joists "FJ."

By reference back to FIG. 1, it can be seen that the attaching portion 14 extends around onto the end edge 11A of the substrate layer 12. Likewise, the overhanging portion 18 of the surface layer 11 extends around onto the end edge 11B of the substrate layer 12. Thus, opposite laterally-extending side edges of the modular structural element 10 complement each other, so that a plurality of modular structural elements 10 can be placed end-to-end in a complementary, interlocking array. See FIGS. 6 and 7.

Figure 3:
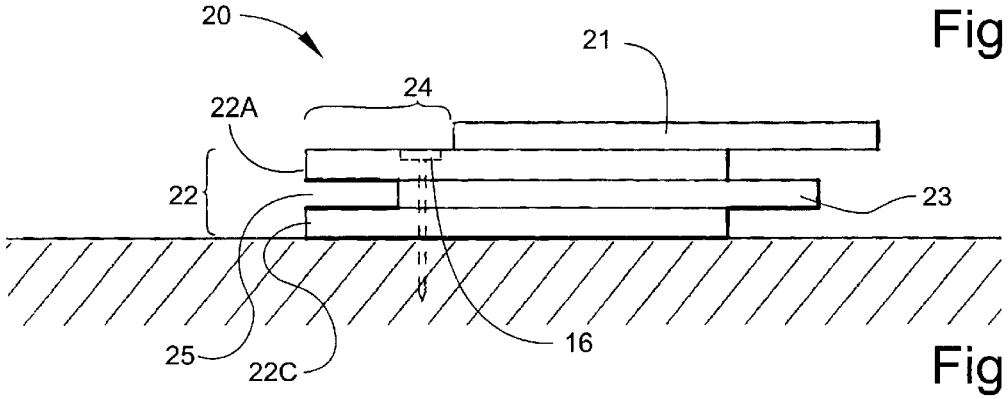
FIG. 3 is a side elevation showing attachment of the modular structural element through the substrate adjacent the groove.

Referring now to FIG. 3, a modular structural element 20 is shown having a similar structure, but wherein the surface layer 21 of cladding material and the substrate layer 22 are oriented such that the surface layer 21 projects outwardly over the tongue 23. An attaching portion 24 of the substrate layer 22 comprises part of the groove 25 defined by spaced-apart wooden extensions 22A and 22C. Fasteners 16 are extended through the attaching portion 24, which resides between the edge of the cladding layer 21 and the innermost portion of the groove 25 in the manner shown in FIG. 3.

Figure 4:
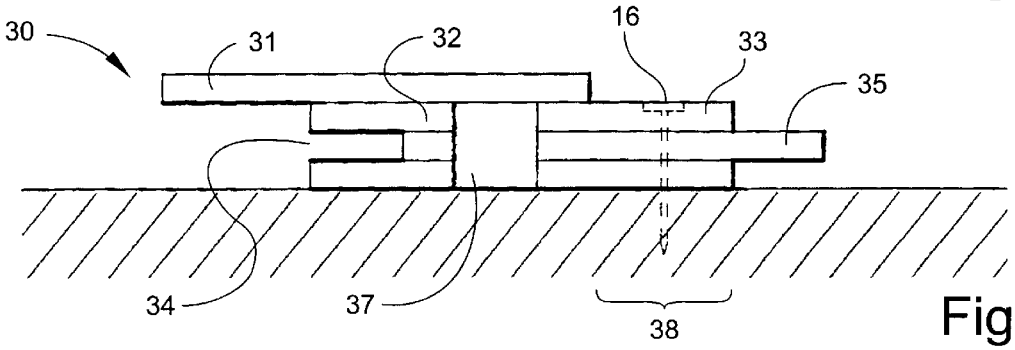
FIG. 4 is a side elevation showing two separated substrates defining a void therebetween.

Referring now to FIG. 4, an alternative construction is shown wherein a modular structural element 30 includes a surface layer 31 of cladding material supported on first and second spaced-apart substrate layer segments 32 and 33. The first substrate layer segment 32 includes a groove 34 and the second substrate layer segment 33 includes a mating tongue 35. A void 37 separates the substrate layer segments 32 and 33 and can be used to accommodate conduit, wiring or insulation. The percentage of the width of the surface layer 31 comprising the void 37 is a function of the overall width of the surface layer 31 and the width of the substrate layer segments 32 and 33. Fasteners 16 are extended through an attaching portion 38 of the substrate layer segment 33.

The substrate layer segment 32 carrying the groove 34 can be positioned as shown in FIG. 3 to receive the fasteners 16, if desired.

Figure 5:
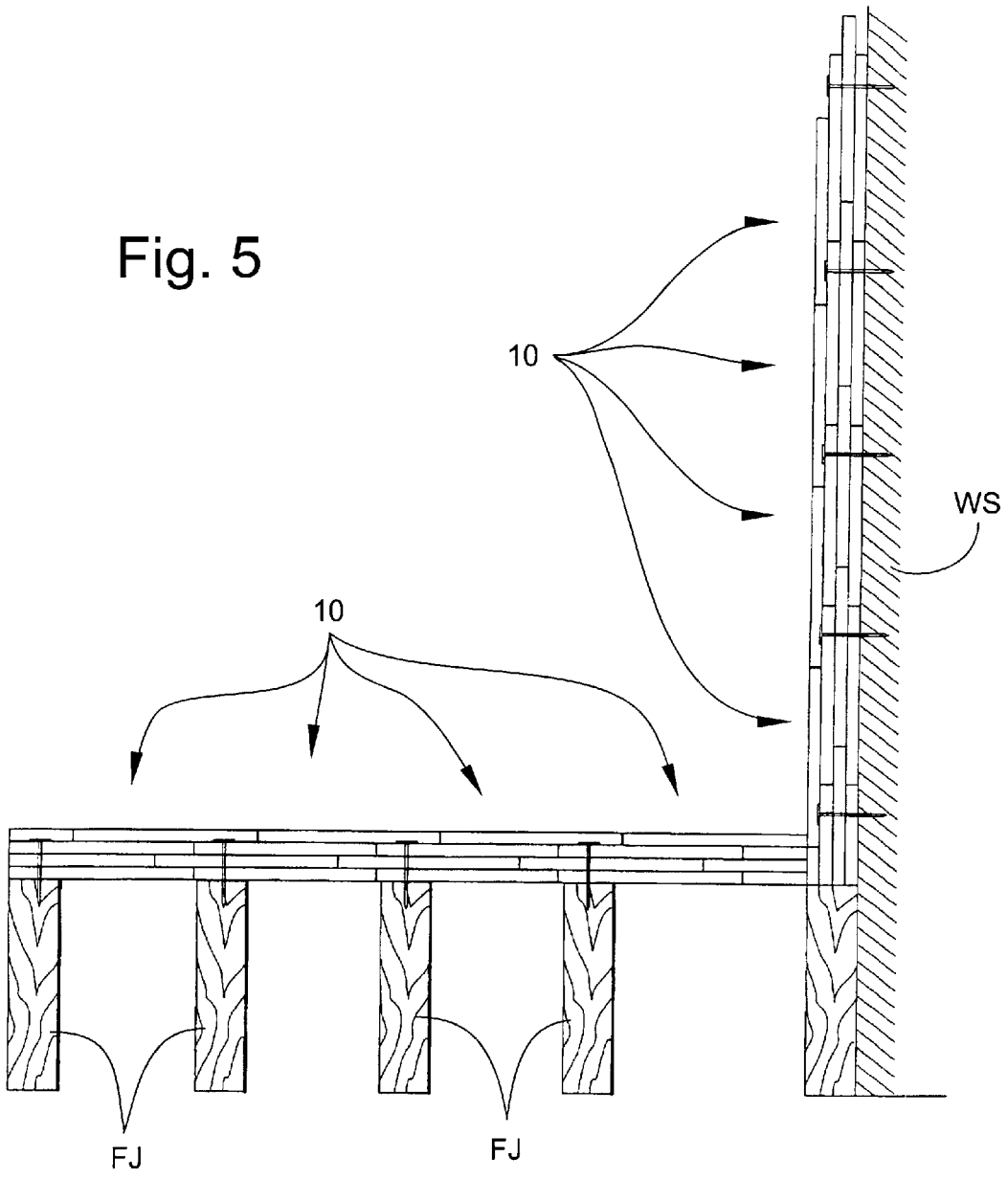
FIG. 5 is a cross-sectional view showing an adjacent floor and wall assembly of the modular structural elements.

As is shown in FIG. 5, an array of the modular structural elements 10 are positioned on and fastened to a series of spaced-apart floor joists "FJ" and adjacent wall studs "WS." The exposed tongue 12B and attaching portion 14 are cut away to the extent necessary to match the required measurements and provide a proper joinder at the point where the floor and wall intersect.

Figure 6:
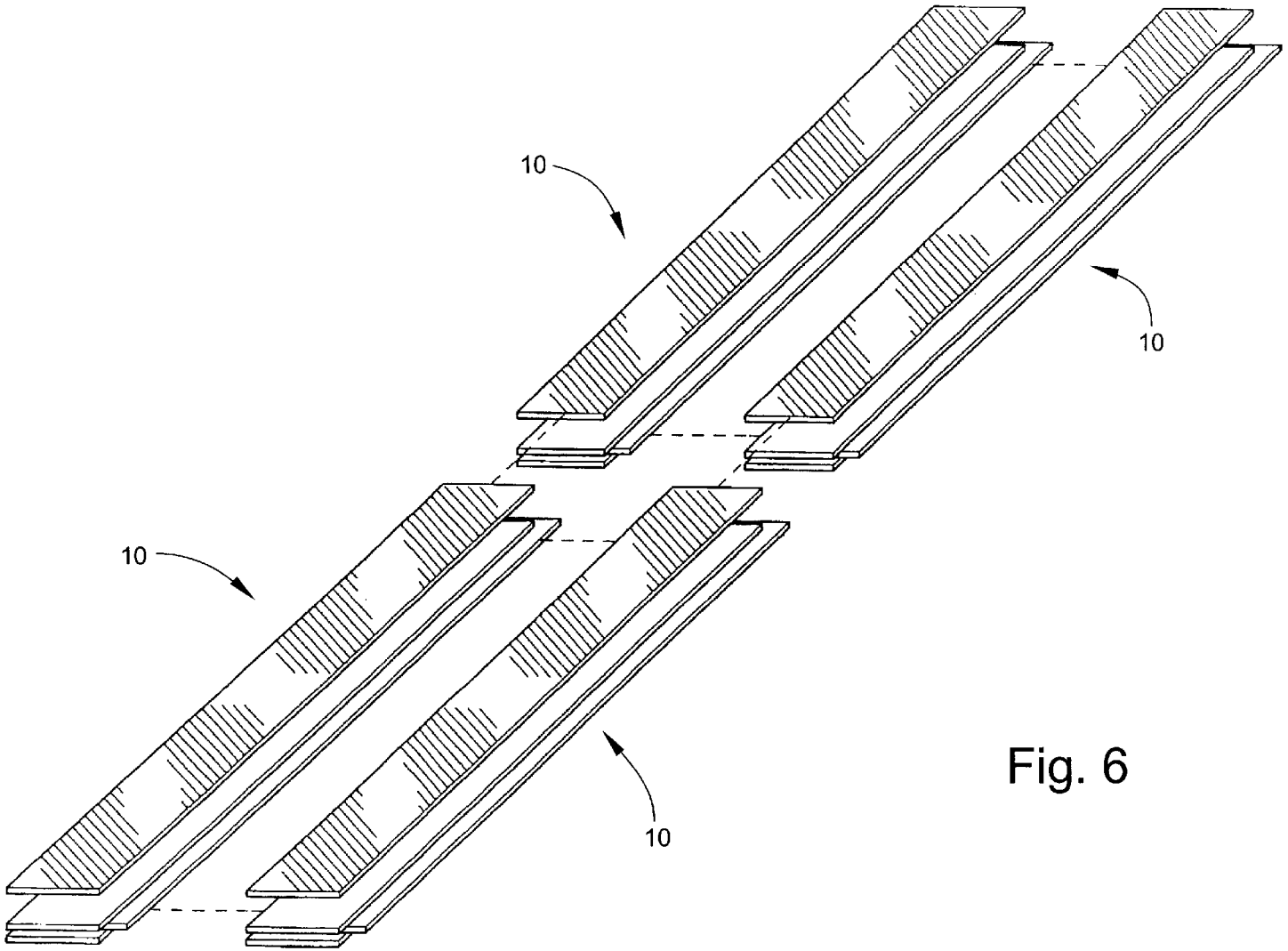
FIG. 6 is a perspective view of four modular structural elements according to one embodiment of the invention, showing lengthwise and widthwise attachment of adjacent modular structural elements.
Figure 7:
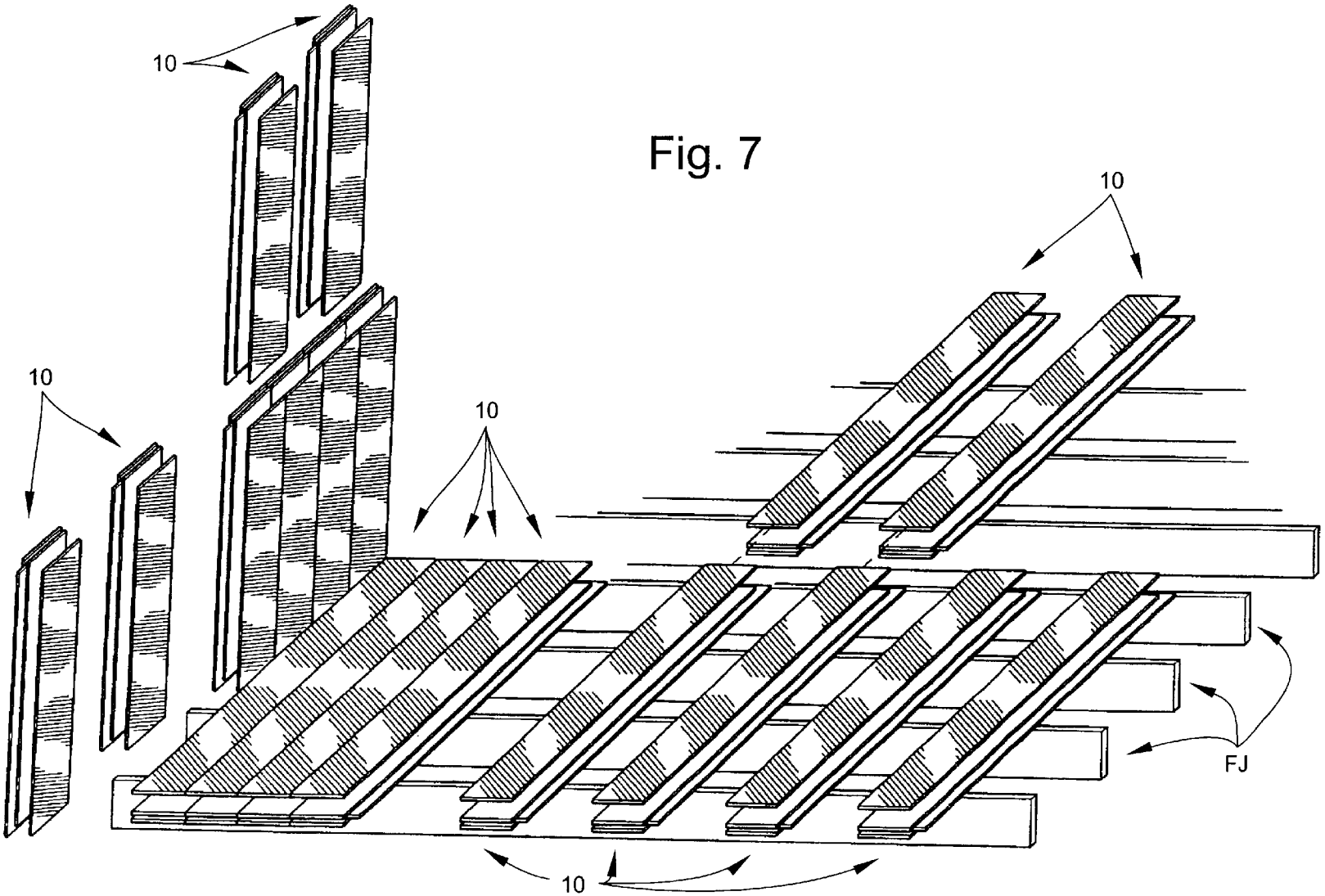
FIG. 7 is an exploded perspective view of a floor and wall assembly of modular structural elements.

FIG. 6 illustrates assembly of four modular structural elements 10 in an array by mating them side-by-side and end-to-end. A more elaborate array is shown in FIG. 7, where both floor and wall surfaces are formed by the modular structural elements 10.

Figure 8:
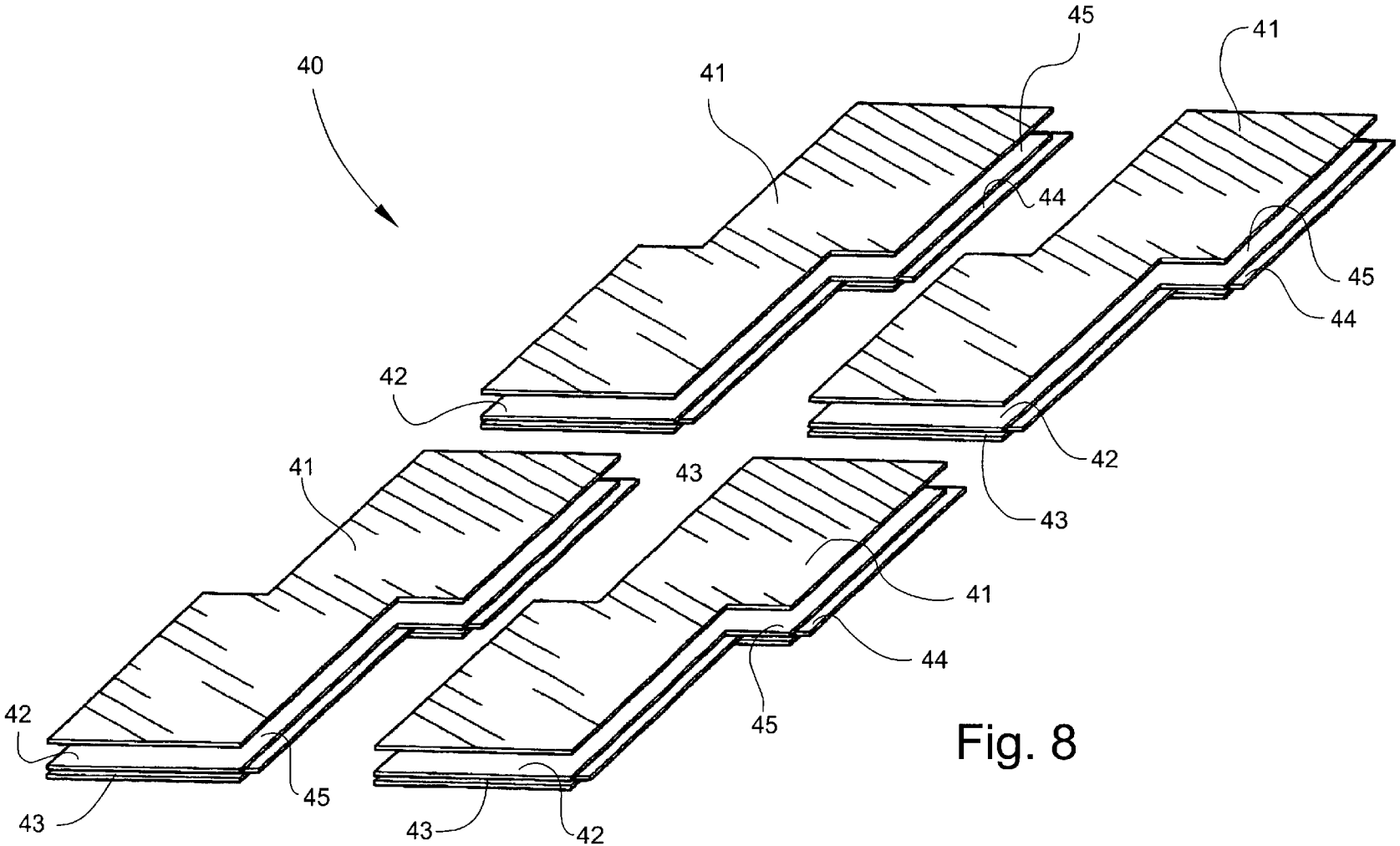
FIG. 8 is an exploded view showing four irregularly-shaped modular structural elements and the manner of interlocking them together.

FIG. 8 shows a modular structural element 40 illustrating a design which is asymmetrical, and which permits the pattern of the surface layer to be other than rectilinear. The surface layer 41 of cladding material is bonded to a substrate layer 42 which includes a tongue 43 and a groove 44. The tongue 43 and groove 44 are positioned so that the tongue 43 of one modular structural element 40 mates in a complementary fashion with the groove 44 of another modular structural element 40, as shown in other figures with reference to other configurations. As with the other shown configurations, the modular structural element 40 is fastened to a supporting structure by any suitable fastener through an attaching portion 45 between the surface layer 41 and the tongue 43.

Figures 9, 10:
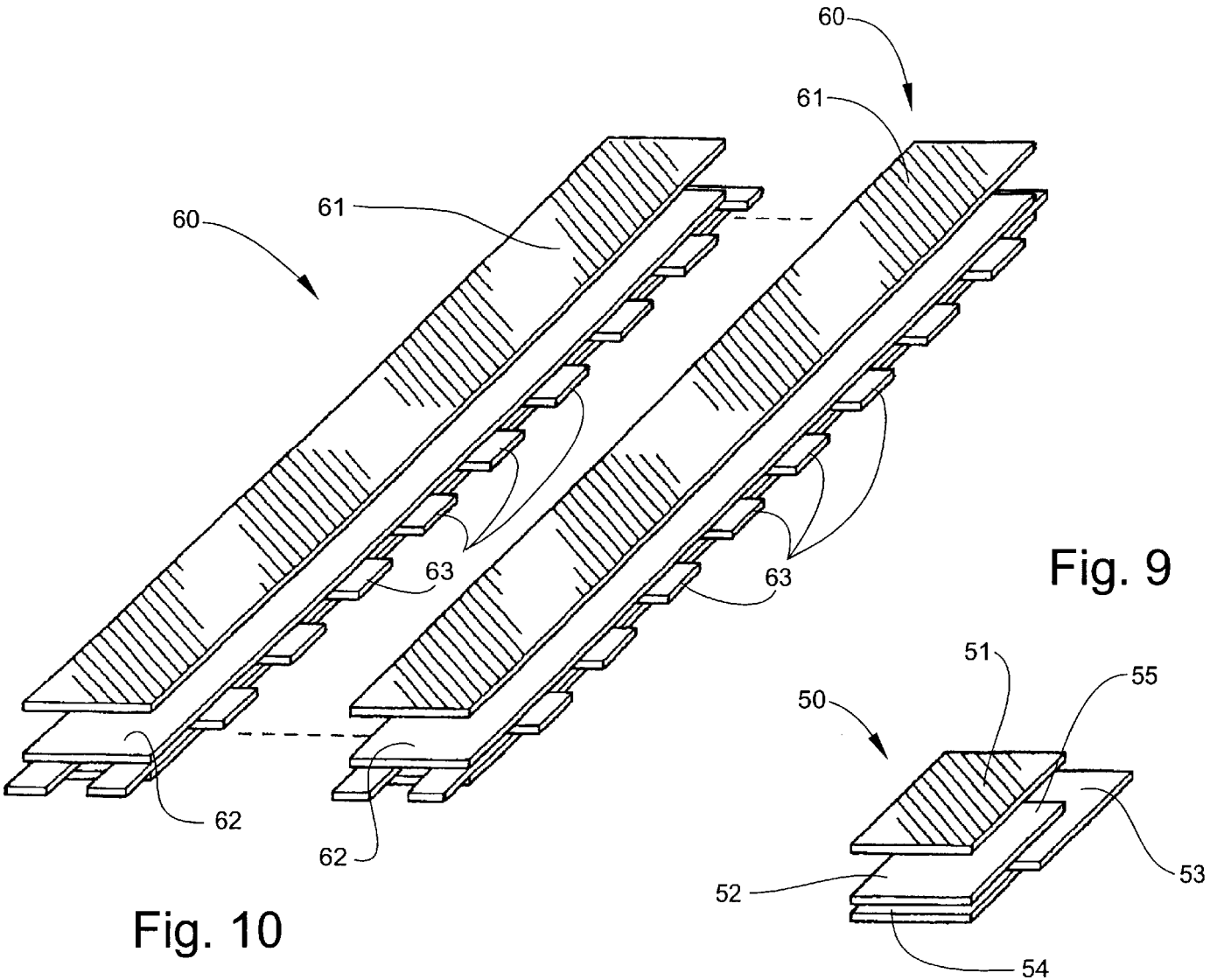
FIG. 9 is a perspective view of a square modular structural element.
FIG. 10 is a perspective view of two modular structural elements having dovetail attachment members.

FIG. 9 illustrates a square modular structural element 50 having a surface layer 51 of a cladding material and a substrate layer 52. A tongue 53 and a groove 54 defined in the substrate layer 52 are positioned so that the tongue 53 of one modular structural element 50 mates in a complementary fashion with the groove 54 of another modular structural element 50, as shown in other figures with reference to other configurations. As with the other shown configurations, the modular structural element 50 is fastened to a supporting structure by any suitable fastener through an attaching portion 55 between the surface layer 51 and the tongue 53.

FIG. 10 shows a pair of modular structural elements 60 having a surface layer 61 of cladding material and a substrate layer 62. Dovetail members 63 on complementary surfaces interlock into each other to secure an array of modular structural elements 60 together in the manner described above.

A modular structural element is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A modular structural element, comprising:

(a) a surface layer of cladding material;

(b) a substrate layer bonded to said layer of cladding material, said substrate layer comprising:

(i) an integrally formed, outwardly-extending attachment flange defined by the entire thickness of the substrate layer and proximal to the surface layer around two adjacent side edges thereof for receiving elongate fastener elements through the entire thickness of the substrate layer and into an underlying support member;

(ii) a tongue projecting outwardly from the attachment flange remote from the surface layer; and (iii) two spaced-apart elements defining a complementary groove therebetween extending along respective adjacent sides of the substrate layer for receiving the tongue of a complementary adjacent structural element;

(iv) the attachment flange residing at all points intermediate the tongue and the surface layer for permitting the tongue to float within the groove of the complementary structural element after attachment of said structural element to an underlying support by the fastener elements through the attachment flange for preventing damage to the surface layer resulting from relative movement between adjacent structural elements.

2. A modular structural element, comprising:

(a) a surface layer of cladding material;

(b) a substrate layer bonded to said layer of cladding material, said substrate layer comprising:

(i) an integrally formed, outwardly-extending attachment flange defined by the entire thickness of the substrate layer and proximal to the surface layer around two adjacent side edges thereof for receiving elongate fastener elements through the entire thickness of the substrate layer and into an underlying support member;

(ii) two spaced-apart elements formed on and extending along respective adjacent sides of the attachment flange remote from the surface layer and defining a groove therebetween;

(iii) a complementary tongue projecting outwardlly from and extending along respective adjacent sides of the substrate layer for being received in a groove of a complementary adjacent structural element;

(iv) the attachment flange residing at all points intermediate the groove and the surface layer for permitting the groove to receive the tounge of the complementary structural element therein after attachment of said structural element to an underlying support by the fastener elements through the attachment flange for preventing damage to the surface layer resulting from relative movement between adjacent structural elements.

3. A modular structural element according to claim 1 or 2, wherein said surface layer is quadrilateral.

4. A modular structural element according to claim 1 or 2, wherein said surface layer comprises a stone material.

5. A modular structural element according to claim 1 or 2, wherein said surface layer comprises glass.

6. A modular structural element according to claim 1 or 2, wherein said surface layer is selected from the group consisting of finished stone, wood, textiles, ceramic, paper, plastic and a combination thereof.

7. A modular structural element according to claim 1 or 2, wherein said surface layer is of a parallelepiped shape with at least five sides.

8. A modular structural element, comprising:

(a) a surface layer of cladding material;

(b) a substrate layer bonded to said layer of cladding material, said substrate layer comprising:

(i) an integrally formed, outwardly-extending attachment flange defined by the entire thickness of the substrate layer and proximal to the surface layer around two adjacent side edges thereof for receiving elongate fastener elements through the entire thickness of the substrate layer and into an underlying support member;

(ii) alternating interlocking tongues carried by and projecting outwardly from respective adjacent sides of the attachment flange remote from the surface layer; and (iii) alternating interlocking grooves defined by two spaced-apart elements extending along respective adjacent sides of the substrate layer for receiving the alternating interlocking tongues of a complementary adjacent structural element;

(iv) the attachment flange residing at all points intermediate the alternating interlocking tongues and the surface layer for permitting the alternating interlocking tongues to interlock with the alternating interlocking grooves of the complementary structural element after attachment of said structural element to an underlying support by the fastener elements through the attachment flange for preventing damage to the surface layer resulting from relative movement between adjacent structural elements.

9. A modular structural element, comprising:

(a) a surface layer of cladding material;

(b) a substrate layer bonded to said layer of cladding material, said substrate layer comprising;

(i) an integrally formed, outwardly-extending attachment flange defined by the entire thickness of the substrate layer and proximal to the surface layer around two adjacent side edges thereof for receiving elongate fastener elements through the entire thickness of the substrate layer and into an underlying support member;

(ii) alternating interlocking grooves defined by two spaced-apart elements carried by and extending along respective adjacent sides of the attachment flange remote from the surface layer; and (iii) alternating interlocking tongues extending along and projecting outwardly from respective adjacent sides of the substrate layer for being received in the alternating interlocking grooves of a complementary adjacent structural element;

(iv) the attachment flange residing at all points intermediate the alternating interlocking groove and the surface layer for permitting the alternating interlocking groove to interlock with the alternating interlocking tongue of the complementary structural element after attachment of said structural element to an underlying support by the fastener elements through the attachment flange for preventing damage to the surface layer resulting from relative movement between adjacent structural elements.

10. A modular structural element according to claim 8 or 9, wherein said first and second alternating interlocking tongues and alternating interlocking grooves comprise dovetail members.

11. A modular structural element according to claim 1, 2, 8 or 9, wherein said surface layer is rectangular.

12. A modular structural element according to claim 1, 2, 8 or 9, wherein said surface layer is square.

* * * * *